United States Patent [19]

McCaffrey

[11] 4,402,270

[45] Sep. 6, 1983

[54] HIGH SPEED DETONATING CORD WITH MODIFIED VELOCITY OF DETONATION

[75] Inventor: Francis H. G. McCaffrey, Brownsburg, Canada

[73] Assignee: CXA Ltd/CXA LTEE, North York, Canada

[21] Appl. No.: 314,760

[22] Filed: Oct. 26, 1981

[30] Foreign Application Priority Data

Nov. 14, 1980 [CA] Canada ..... 364671

[51] Int. Cl.[3] ..... F42B 3/10; C06C 5/04

[52] U.S. Cl. ..... 102/275.3; 102/275.7; 102/275.8; 102/276

[58] Field of Search ..... 102/275.8, 275.7, 275.1, 102/275.2, 275.3, 275.4, 275.9, 275.12, 277.1, 277.2, 200, 276; 86/1 R

[56] References Cited

U.S. PATENT DOCUMENTS

| | | | |
|---|---|---|---|
| 3,590,739 | 7/1971 | Persson | 102/275.8 X |
| 3,730,096 | 5/1973 | Prior | 102/275.8 |
| 4,328,753 | 5/1982 | Kristensen et al. | 102/275.8 X |

*Primary Examiner*—David H. Brown

[57] ABSTRACT

A very-high-detonation-velocity detonating cord of the type having axial hollow space within the core is modified in its velocity of detonation by inserting at selected locations within the hollow core, elongated, flexible blockage elements. By a selection of the number of such blockage elements, the VOD of the cord may be controlled within narrow limits. Detonating cord having specific or controlled VOD has particular application in explosives welding and metal working.

5 Claims, 2 Drawing Figures

Fig. 1
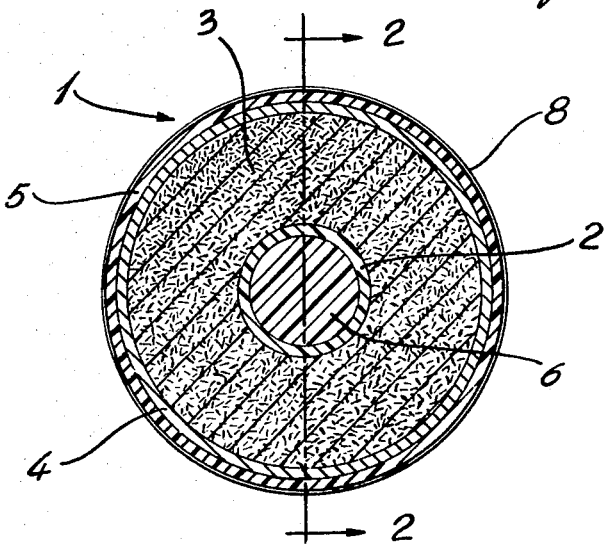
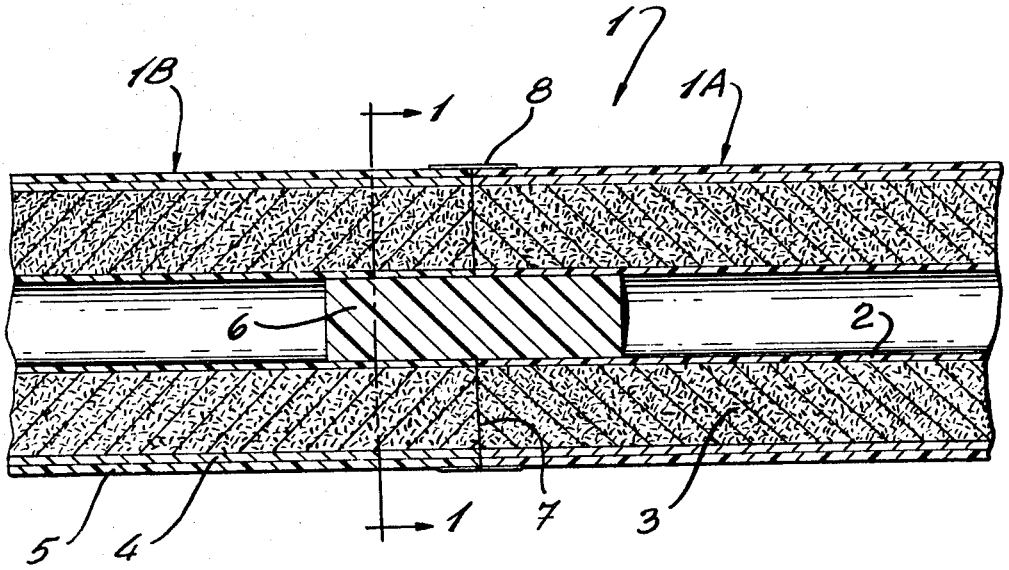
Fig. 2

HIGH SPEED DETONATING CORD WITH MODIFIED VELOCITY OF DETONATION

The present invention relates to detonating cord having a very high rate of detonation velocity. In particular, the invention deals with a means whereby the velocity of detonation of "fast" detonating cord may be reduced or slowed without changing the amount of density of the explosive charge contained therein.

By "fast" detonating cord is meant a detonating cord having a lineal velocity of detonation in excess of 6500 meters per second. Such a fast cord is described by Josef Prior in U.S. Pat. No. 3,730,096, granted May 1, 1973. This fast cord comprises a core of high explosive surrounded by a sheath or covering and having a hollow space within the core extending over the length of the cord. Such a cord is manufactured by building it around a thin, flexible tube or plastic resin material, such as polyethylene, thus providing a finished cord having an axial hollow space or hollow core along its entire length. Typically a hollow-core, fast detonating cord contains as the inner hollow element an extruded low density polyethylene tubing having an inner diameter of 0.03 inch and an outer diameter of 0.075 inch. It has been surprisingly found that the provision of such an axial hollow space or core serves to increase the velocity of detonation by up to 35% over a similar cord containing an equal amount of high explosives but devoid of any axial hollow core.

Very high velocity detonating cord has particular utility in blasting operation where close control over timed initiation of two or more explosive charges is required as, for example, in multi-second delay sequential blasting. Another particular application of closely timed blasting control is in the field of explosive metal working or explosive welding where separate explosive charges on each face of metal to be worked are required to be initiated simultaneously or nearly simultaneously.

In some cases, the distances between point of initiation of the detonating cords and the position of the explosive charges can vary as, for example, in the inside/outside welding of large diameter metal pipes as described in pending Canadian patent application Ser. No. 350,668 filed Apr. 25, 1980. In such a procedure, band-like explosive charges are superimposed around the inside and outside of overlapped pipe ends and simultaneously detonated by means of fast detonating cords placed along an edge of each band charge. In, for example, a 42 inch diameter, $\frac{3}{4}$ inch steel pipe having overlapped ends to be welded, the outer circumference and hence the length of the initiating fast cord is 139 inches while the inner circumferential cord length is 125 inches.

To achieve in-step simultaneous detonation of the inner and outer explosive band charges where the outer cord VOD is 8400 m/sec., the VOD of the inner cord must be slowed to 7550 m/sec. in order to provide in-step initiation. For such application it has been necessary to fabricate cords of slightly different velocities of detonation and to carefully match pairs of cords to achieve optimum results. Manufacture of detonating cords, particularly very high velocity cords, having marginally different velocities of detonation is not without difficulty since very careful adjustments to the manufacturing process are required and subsequent careful testing must be undertaken to achieve the desired results.

It has now been found that the velocity of detonation of a standard, hollow-core fast detonating cord can be marginally slowed without the need to modify manufacturing procedures. Furthermore, a modified or "slowed" hollow-core cord can be made in which a desired percentage reduction in detonation velocity is provided without alteration of either explosive content or its density. More importantly, the noted modifications can be undertaken 'in the field' without use of any costly equipment.

The modified very high velocity hollow-core detonating cord of the invention comprises a detonating cord having a high explosive core, a sheath surrounding the high explosive core and a linear hollow space within the said core extending the length of the said cord, the said linear hollow space containing at selected intervals therein areas of blockage of selected length.

The modified cord of the invention may be better understood by reference to the appended drawing wherein FIG. 1 shows in cross-section a portion of the cord of the invention wherein the inner hollow linear space contains a blockage and FIG. 2 shows a sectional view of a length of cord containing a blockage element which blockage may be placed at intervals along the inner hollow space.

With reference to FIG. 1 there is shown a length of very high velocity detonating cord 1 having an empty internal tube 2 of, for example, a flexible thermoplastic material such as polyethylene, Surlyn (Reg. TM) modified polyethylene or Tygon (Reg. TM) modified vinyl polymer surrounded by very finely granulated explosive charge 3 such as PETN or the like. Charge 3 is sheathed by means of, for example, a winding of braided filaments 4 over which is a waterproof coating 5. Located in tight fit within the internal space of tube 2 is a flexible, elongated blockage element 6 which comprises a selected short length of filamentary material such as, for example, synthetic plastic cord or metal wire.

With reference to FIG. 2, where similar numbers are used to designate similar parts, there is shown a high velocity detonating cord 1 which has been severed along line 7 to form two cord sections 1A and 1B. Within cord 1 is internal hollow tube 2, a surrounding high explosive charge, 3, filamentary winding 4 and waterproof coating 5. 6 designates a selected short length of a tight-fitting blockage element such as for example a nylon monofilament. Flexible, elongated blockage element 6, preferably glued in place, is located so that approximately half its length is secured within tube 2 of cord section 1A and the remainder of its length is secured within tube 2 of cord section 1B. Thus element 2 serves to connect together cord sections 1A and 1B and at the same time blocks the free space within tube 2. An overwrap of adhesive tape 8 is shown at the junction of cord sections 1A and 1B to provide water proofness and to guard against loss of explosive charge 3 at the joint line 7.

EXAMPLE 1

A length of high velocity, hollow-core detonating cord having an explosive content of 200 grains per foot of PETN and an established velocity of detonation (VOD) of 8300 meters per second was selected for testing. At an appropriate point the cord was cut. A 15.4 cm length of nylon monofilament having a diameter substantially equal to the hollow center hole of the cord was inserted 7.7 cm into the center of each end of the cut cord and secured therein by means of a small amount of glue. The thus connected cord sections were secured to a wooden dowell to maintain straightness and one end was initiated by means of a connected electric blasting cap.

Prior to initiation, continuous velocity recording equipment was attached along the cord so that the velocity could be monitored for a distance ahead of the inserted nylon monofilament, across the blocked section and for some distance beyond the blockage. After initiation, the velocity ahead of the joint area was 8300 m/sec. At the beginning of the section of the cord blocked by the nylon monofilament the velocity dropped to 5980 m/sec. and remained at this level over the 15.4 cm length of blockage. Once past the blockage, over a length of about 7 to 8 cm, the velocity rapidly built up to 8300 m/sec. and remained steady for the remainder of the monitored portion of the cord.

It is thus seen that the blockage by the nylon monofilament results in a decrease in velocity over the length of the blockage. In effect, the explosive in this section of the cord reacts as if no central tube is present. It has been shown that following the blockage, the run-up in velocity over the next 7–8 cm from 6000 m/sec. to 8300 m/sec. is quite constant for similar types of hollow cords.

EXAMPLE 2

It has been found that the amount of reduction in VOD in blocked fast cord is proportional to the length of the blockage element. A series of 1.5 meter lengths of test cords containing 42.5 grams per meter of PETN and having VOD's in excess of 8450 m/sec. were cut and blockages of various lengths were placed at the mid-points of one meter sections which were monitored for velocity of detonation.

The cords were initiated from the end by means of an attached blasting cap and the VOD of each cord was measured over the one meter length of the cord by means of a chronograph. The results are tabulated in Table I below.

TABLE I

| Sample description | Length of insert | Kind of insert | Number of V.O.D. readings | Average recorded velocity over 1 meter |
|---|---|---|---|---|
| H.V. Type Cord | 0 | Nil | 2 | 8496 |
| | 2" | Nylon | 2 | 8278 |
| H.V. Type Cord | 4" | " | 2 | 8164 |
| H.V. Type Cord | 6" | " | 1 | 8039 |
| H.V. Type Cord | 0 | Nil | 2 | 8500 |
| | 1½" | Nylon | 2 | 8379 |
| H.V. Type Cord | 2½" | " | 2 | 8305 |
| H.V. Type Cord | 3½" | " | 2 | 8261 |
| H.V. Type Cord | 4½" | " | 2 | 8134 |
| H.V. Type Cord | 0 | Nil | 3 | 8479 |
| | 4½" | Nylon | 3 | 8132 |
| H.V. Type Cord | 5½" | " | 3 | 8060 |
| H.V. Type Cord | 0 | Nil | 4 | 8469 |
| | 1" | Nylon | 4 | 8394 |
| H.V. Type Cord | 3½" | " | 4 | 8192 |
| H.V. Type Cord | 6" | " | 5 | 8052 |

| Sample Description | Difference from control m/sec. | Remarks |
|---|---|---|
| H.V. Type Cord | — | Control sample no joint |
| H.V. Type Cord | 218 | 30 lb test nylon monofilament fishing line .022" diameter |
| H.V. Type Cord | 332 | |
| H.V. Type Cord | 457 | |
| H.V. Type Cord | — | Control sample no joint |
| H.V. Type Cord | 121 | All samples - 30 lb test nylon monofilament fishing line .022" diameter |
| H.V. Type Cord | 195 | |
| H.V. Type Cord | 239 | |
| H.V. Type Cord | 366 | |
| H.V. Type Cord | — | Control sample no joint |
| H.V. Type Cord | 347 | Different sample of H.V. cord .022" diameter nylon monofilament |
| H.V. Type Cord | 419 | |
| H.V. Type Cord | — | Control sample no joint |
| H.V. Type Cord | 75 | Same sample of H.V. cord as above .022" diameter nylon monofilament |
| H.V. Type Cord | 277 | |
| H.V. Type Cord | 417 | |

EXAMPLE 3

The effect of different types of blockage material, namely nylon filament, tinned iron wire and tinned copper wire, was examined. With 1.5 m samples of fast cord having a VOD (average) of 8446 m/sec. and containing 42.5 grams per meter of PETN, various lengths of selected blockage material were inserted as hereinbefore described and the cords were initated by means of electric blasting caps. The VOD of each sample was measured over a one meter length of the cord, the blockage element being at the centre point of the one meter length. The results shown in Table II below indicate that substantially similar reductions in VOD are achieved independent of the material comprising the blockage element.

TABLE II

| Sample description (1) | Sample numbers cutting sequence | Material & length of blockage | Recorded Velocity over 1 m | Average Velocity m/sec. | Difference from control m/sec. |
|---|---|---|---|---|---|
| H.V. cord | 9 | None | 8453 | — | — |
| .030 × .075" | 21 | " | 8439 | 8446 | — |
| tube - no blocking | 29 | " | 8446 | — | — |
| H.V. cord | 4 | Nylon | 8299 | — | — |
| .030 × .075" | 22 | 2" | 8237 | 8277 | 169 |
| tubing blocked with nylon | 25 | | 8292 | — | — |
| H.V. cord | 5 | Nylon | 8000 | — | — |
| .030 × .075" | 10 | 4" | 7855 | 7988 | 458 |
| tubing blocked with nylon | 19 | | 8110 | — | — |

TABLE II-continued

| Sample description (1) | Sample numbers cutting sequence | Material & length of blockage | Recorded Velocity over 1 m | Average Velocity m/sec. | Difference from control m/sec. |
|---|---|---|---|---|---|
| H.V. cord | 7 | Nylon | 7943 | — | — |
| .030 × .075" | 23 | 6" | 7788 | 7914 | 532 |
| tubing blocked with nylon | 27 | | 8012 | — | — |
| H.V. cord | 13 | Copper | 8285 | — | — |
| .030 × .075" | 17 | 2" | Chrone* | 8265 | 181 |
| tubing blocked with copper wire | 30 | | 8244 | — | — |
| H.V. cord | 2 | Copper | 8091 | — | — |
| .030 × .075" | 14 | 4" | Chrono* | 8114 | 332 |
| tubing blocked with copper wire | 24 | | 8137 | — | — |
| H.V. cord | 6 | Copper | 7981 | — | — |
| .030 × .075" | 16 | 6" | 7983 | 7994 | 452 |
| tubing blocked with copper wire | 20 | | 8019 | — | — |
| H.V. cord | 8 | Iron | 8244 | — | — |
| .030 × .075" | 12 | 2" | 8257 | 8260 | 186 |
| tubing blocked with iron wire | 29 | | 8278 | — | — |
| H.V. cord | 1 | Iron | 8130 | — | — |
| .030 × .075" | 15 | 4" | 8130 | 8126 | 320 |
| tubing blocked with iron wire | 18 | | 8117 | — | — |
| H.V. cord | 3 | Iron | 7974 | — | — |
| .030 × .075" | 11 | 6" | 7987 | 7953 | 493 |
| tubing blocked with iron wire | 26 | | 7898 | — | — |

*Problems with chronograph, hence no reading shown
(1) All samples cut from one reel of cord in sequence shown by sample numbers For practical application in the field, it is necessary to provide for a precise reduction in velocity of detonation of a fast cord in order to achieve optimum blasting results. From chronograph measurements of the blocked and unblocked segments of hollow-core detonating cord, it has been found that the VOD of a blocked segment of cord is nearly identical to that of a solid explosive core detonating cord having the same quantity of explosives per linear foot. Thus, a hollow-core cord having an explosive load of 200 g/foot of PETN and a VOD of 8400 m/sec. will, if blocked by an internal lineal blocking element, detonate at a VOD of 6000 m/sec. over the blocked area which VOD corresponds to a normal solid-core of 200 g/foot PETN. If, for example, in inside/outside explosive pipe welding where a reduction of VOD of 5% is required for the inside initiating cord—that is, an outside cord having a VOD of 8400 m/sec. is required to be matched with an inside cord having a 5% slower VOD of 8000 m/sec.—it can be calculated that a blockage element 11.5 cm inserted in a one meter length of hollow-core cord will reduce the VOD of that cord by 5% to a VOD of 8000 m/sec. By similar calculations based on experimental data for each cord any desired reduction in VOD can be provided through the use of one or more blockage elements of selected length.

While the reduction of VOD in hollow-core cord has been demonstrated by the insertion of a blockage element in a spliced length of cord having a uniform VOD, it will be appreciated that it is also possible to modify VOD by combining in the same manner one or more lengths of high VOD hollow cord with one or more lengths of less high VOD hollow cord. Such a combination would provide for a cumulated slowing of VOD from both an inserted blockage element at the point of splice and the lengths of less high VOD cord.

A particular advantage of the invention is in the ease with which the reduction of VOD in fast, hollow-core cord can be affected particularly in the field. With a knowledge of the VOD of an unmodified fast cord, the blasting technician need only sever the cord, insert one or more blockage elements of chosen length and rejoin the severed sections in order to produce a cord having a calculated, reduced VOD. Equal lengths of the unmodified fast cord and the slowed cord may then be employed to achieve a controlled millisecond delay blasting result.

I claim:

1. A method for modifying the velocity of detonation of a very-high-detonation-velocity detonating cord having a core of high explosive, a sheath surrounding said core and at least one hollow space within said core extending over the length of the said cord, which method comprises interposing at one or more positions within and along the said hollow space a flexible, elongated blockage element.

2. A modified very-high-detonation-velocity detonating cord consisting of a core of high explosives, a sheath surrounding said core and a hollow space within said core extending over the length of the said core, the said hollow space containing at one or more locations therealong a flexible, elongated blockage element.

3. A modified detonating cord as claimed in claim 2 wherein the said flexible elongated blockage element is retained within the said hollow space by means of an adhesive.

4. A modified detonating cord as claimed in claim 2 wherein the said flexible, elongated blockage element is selected from the group of synthetic plastic or metal filaments.

5. A modifier detonating cord as claimed in claim 4 wherein the synthetic plastic filament blockage element is a nylon monofilament.

* * * * *